US012696957B2

(12) United States Patent
Chen

(10) Patent No.: US 12,696,957 B2
(45) Date of Patent: Aug. 4, 2026

(54) FOOTWEAR

(71) Applicant: Candace Chen, Phoenix, AZ (US)

(72) Inventor: Candace Chen, Phoenix, AZ (US)

( * ) Notice: Subject to any disclaimer, the term of this patent is extended or adjusted under 35 U.S.C. 154(b) by 354 days.

(21) Appl. No.: 18/590,683

(22) Filed: Feb. 28, 2024

(65) Prior Publication Data

US 2024/0197038 A1 Jun. 20, 2024

Related U.S. Application Data

(63) Continuation-in-part of application No. 17/806,059, filed on Jun. 8, 2022, now abandoned.

(60) Provisional application No. 63/212,645, filed on Jun. 19, 2021.

(51) Int. Cl.
*A43B 21/36* (2006.01)
*A43B 13/18* (2006.01)

(52) U.S. Cl.
CPC ..... *A43B 21/36* (2013.01); *A43B 13/187* (2013.01)

(58) Field of Classification Search
CPC ..... A43B 13/189; A43B 13/41; A43B 21/26; A43B 21/24; A43B 21/32; A43B 21/51; A43B 3/103
See application file for complete search history.

(56) References Cited

U.S. PATENT DOCUMENTS 5,339,543 A * 8/1994 Lin ..... A43B 3/24 36/15
9,693,598 B1 * 7/2017 Rose ..... A43B 21/46
2015/0164180 A1 * 6/2015 Lee ..... A43B 7/144 36/105

* cited by examiner

*Primary Examiner* — Haley A Smith

(57) ABSTRACT

An elegant and stylish high-heeled shoe includes improved arch supports, pads, and gel-filled cushions, and improves wearer comfort and improves weight distribution by collecting and transferring body weight primarily by the ball of the heel, secondarily by a novel arch support, and tertiarily by an especially comfortable toe post. These distributed support structures in combination prevent an undesirable feeling of the foot sliding down the ramp.

20 Claims, 6 Drawing Sheets

A-A

A-A

B-B

DETAIL C

DETAIL "D"

E-E

FOOTWEAR

COPYRIGHT STATEMENT

A portion of the disclosure of this patent document contains material that is subject to copyright protection. The copyright owner has no objection to the facsimile reproduction by anyone of the patent document or the patent disclosure as it appears in the Patent and Trademark Office patent file or records, but otherwise reserves all copyright rights whatsoever.

CROSS REFERENCE TO RELATED APPLICATION

This non-provisional utility application is a continuation-in-part application proceeding from non-provisional utility application Ser. No. 17/806,059 "Footwear," filed 8 Jun. 2022 and currently pending. That application Ser. No. 17/806,059 "Footwear," filed 8 Jun. 2022 claims the benefit of and priority to U.S. provisional application Ser. 63/212,645 "Footwear," filed 19 Jun. 2021 and now expired.

The entire contents of U.S. provisional application Ser. 63/212,645 "Footwear," filed 19 Jun. 2021 and non-provisional utility application Ser. No. 17/806,059 "Footwear," filed 8 Jun. 2022 are hereby incorporated into this document by reference.

FIELD

The invention relates to footwear and especially to fashionable and attractive high-heeled shoes.

BACKGROUND

High-heeled shoes have been a popular fashion item, and some sources date their earliest origins to the 15th century. However users often find the currently available designs to be uncomfortable after long hours of wearing, and some pedestal designs in the raised heel section contribute to instability in the ankle while walking which may increase the risk of a fall or a sprained ankle.

Weight distribution is often left unaddressed by designs created for ornamentality rather that for safe or comfortable use. Significantly, the throat section of high heeled shoes may deleteriously act as a ramp allowing the arches of the wearer's feet to slide down toward the toe section of the shoe, which is either restrained uncomfortably in the toe cap or toe band of the shoe, or which causes the wearer to lean uncomfortably.

BRIEF DESCRIPTION

A primary objective of the invention is to provide a stylish and elegant design for a high-heeled shoe.

Another objective of the invention is to reduce discomfort while wearing and walking with the inventive high-heeled shoe. A corollary objective of the invention is to offer shape-compliant surfaces which provide improved comfort.

Yet another objective of the invention is to offer improved stability over existing and prior designs. A corollary objective of the invention is to support certain portions of the wearer's foot in the shoe so as to collect the body weight over a distributed and novel set of weight-bearing surfaces. Another objective of the invention is to eliminate the feeling in the wearer of the foot seemingly sliding out of the heel pocket and uncomfortably relying primarily on the toe strap, toe box, or toe post to arrest the foot from sliding down the ramp or throat of the insock.

BRIEF DESCRIPTION OF THE DRAWINGS

A further understanding of the nature and advantages of particular embodiments may be realized by reference to the remaining portions of the specification and the drawings, in which like reference numerals are used to refer to similar components. When reference is made to a reference numeral without specification to an existing sub-label, it is intended to refer to all such multiple similar components.

DETAILED DESCRIPTION OF CERTAIN EMBODIMENTS

Figure 1A:
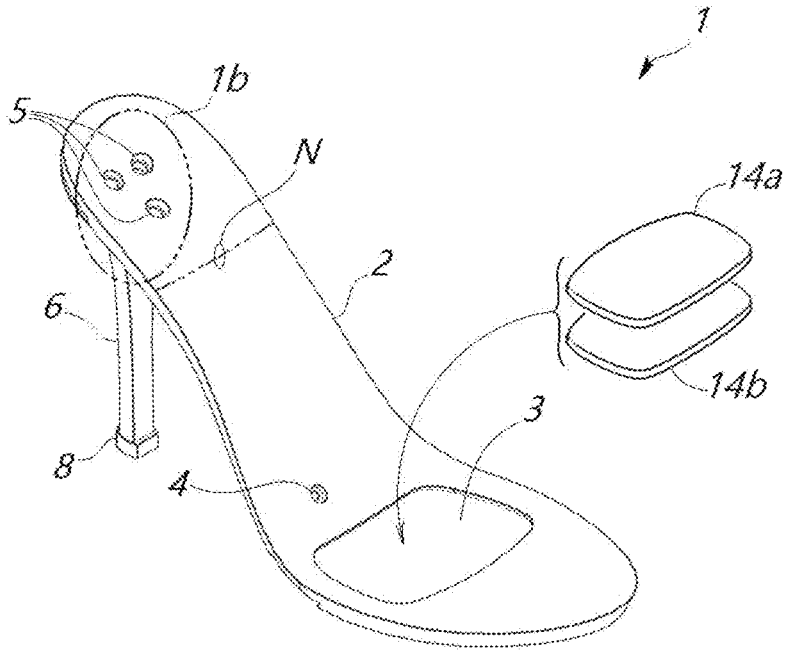
FIG. 1*a* shows a front, right, top view of a high-heeled shoe in accordance with the invention, fashioned for the right foot, with a gel pad and a component comprising high-rebound memory foam affixed atop the gel pad exploded from an insole pocket wherein they reside.

While various aspects and features of certain embodiments have been summarized above, the following detailed description illustrates a few exemplary embodiments in further detail to enable one skilled in the art to practice such embodiments. The described examples are provided for illustrative purposes and are not intended to limit the scope of the invention.

In the following description, for the purposes of explanation, numerous specific details are set forth in order to provide a thorough understanding of the described embodiments. It will be apparent to one skilled in the art, however, that other embodiments of the present invention may be practiced without some of these specific details. Several embodiments are described herein, and while various features are ascribed to different embodiments, it should be appreciated that the features described with respect to one embodiment may be incorporated with other embodiments as well. By the same token, however, no single feature or features of any described embodiment should be considered essential to every embodiment of the invention, as other embodiments of the invention may omit such features.

In this application the use of the singular includes the plural unless specifically stated otherwise, and use of the terms "and" and "or" is equivalent to "and/or," also referred to as "non-exclusive or" unless otherwise indicated. Moreover, the use of the term "including," as well as other forms, such as "includes" and "included," should be considered non-exclusive. Also, terms such as "element" or "component" encompass both elements and components comprising one unit and elements and components that comprise more than one unit, unless specifically stated otherwise.

The invention provides an elegant and stylish high-heeled shoe that includes improved arch supports, pads, and gel-filled cushions to enhance ankle stability and wearer comfort and improved weight distribution, by collecting and transferring body weight primarily by the ball of the heel and secondarily by an arch support and tertiarily by a toe ridge. These distributed support structures in combination prevent an undesirable feeling of the foot sliding down the ramp.

For all figures, reference numerals and reference letters for elements described in any one figure represent the same elements as they appear and are referenced in any other figures, without requiring redundant recitation of the same description in those other figures.

Referring to the figures, FIG. 1*a* shows a front, right, top view of a high-heeled shoe [1] in accordance with the invention, fashioned for the right foot, with a first gel pad [14*b*] and a component [14*a*] comprising high-rebound memory foam affixed atop the gel pad exploded from an insole pocket [3] wherein which they are received. The shoe as an assembly further comprises a heel pillar [6,] an outer sole [2] and an insock which is also referred to as an inner sole. The throat section of the outer sole includes at least one aperture [4] for fasteners to secure a shank such as a steel, metal, or rigid polymer reinforcement. The shank extends along the throat section of the outer sole. The heel portion of the outer sole includes outer a plurality of apertures [5] for fasteners which secure a heel counter [6] to the outer sole. A top lift [8] is affixed to the underside of the tip of the heel pillar.

In this specification the term "positive curvature" is used to define curved lines and surfaces which at their lateral portions bend away from a theoretical viewer, such as the outside surface of a can or a ball. The term "negative curvature" is used to define curved lines and surfaces which at their lateral portions bend toward a theoretical viewer, such as the inside surface of a can or a ball. The descending portion of the throat includes a transverse line of inflection [N] where the shoe surface transitions from negative curvature such as in the vicinity of the heel cup, to positive curvature such as the throat of the shoe beneath the wearer's arch. The reference numeral [lb] in this figure defines the portion of the shoe shown in FIG. 1*b*. The outer sole also defines a heel cup in this portion which is also illustrated and discussed in other figures.

Figure 1B:
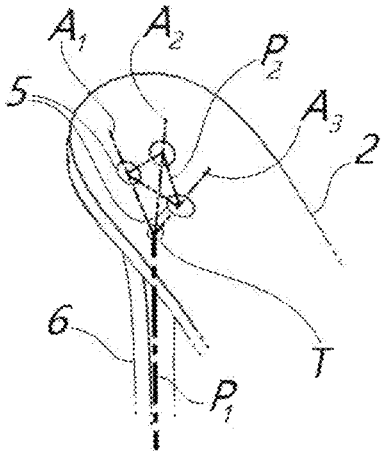
FIG. 1*b* shows a close-up of a heel cup portion of the shoe of FIG. 1*a*, and further illustrates a support axis residing in the heel pillar and a set of brachial support axes that converge upon the support axis at a point beneath the heel cup.

FIG. 1*b* shows a close-up of a heel cup portion of the shoe of FIG. 1*a* and further illustrates a support axis [$P_1$] residing in the heel pillar and a set of brachial support axes [$A_1$,] [$A_2$,] and [$A_3$,] that converge upon the support axis at a point [T] beneath the heel cup. The heel cup includes a plurality of fastener-receiving through apertures that have centers non-coaxial with the support axis. In this illustration the number of apertures is three but more or fewer apertures may also be employed. The plurality of apertures may reside at apices of a regular or irregular polygon. Each aperture defines a center, and the brachial support axes each pass through a respective aperture center and converge upon the support axis at a point beneath the heel cup. At least three of these center points are located where each axis passes through its through aperture of the heel cup, and these three points define a plane [$P_2$.]

Figure 1C:
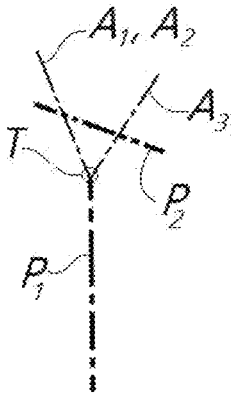
FIG. 1*c* shows a side view of the support axis and the brachial support axes seen in FIG. 1*b* and the plane defined by points where the brachial support axes pass through centers of through apertures of the heel cup, which apertures are used for fasteners to secure the heel pillar to the underside of the insock.

FIG. 1*c* shows a side view of the support axis [$P_1$] and the brachial support axes [$A_1$,] [$A_2$,] and [$A_3$] seen in FIG. 1*b*. In this view brachial support axes [$A_1$] and [$A_2$] appear coincident, and they all converge upon the support axis at a point [T.] The plane [$P_2$] is defined by points where the brachial support axes pass through centers of through apertures of the heel cup, and roughly coincides with the seating plane of a user's heel when received within the heel cup. The apertures or through holes are used for fasteners to secure the heel pillar to the underside of the insock. The fasteners, especially if they are threaded fasteners, may be installed coaxial with their brachial support axes or may be installed with their axes substantially parallel to the support axis. According to some assembly methods, fasteners at these and other locations may be heated prior to installation so that thermoplastic or thermosetting materials may be softened by heat transfer from the fastener and grip the fastener better to resist loosening later in the service life of the shoes. With the heated fastener method, the fastener-receiving apertures may be fashioned to be undersized with respect to the fastener diameter passing through the aperture to promote better gripping as the softened material flows into shape around the installed fastener.

Figure 2:
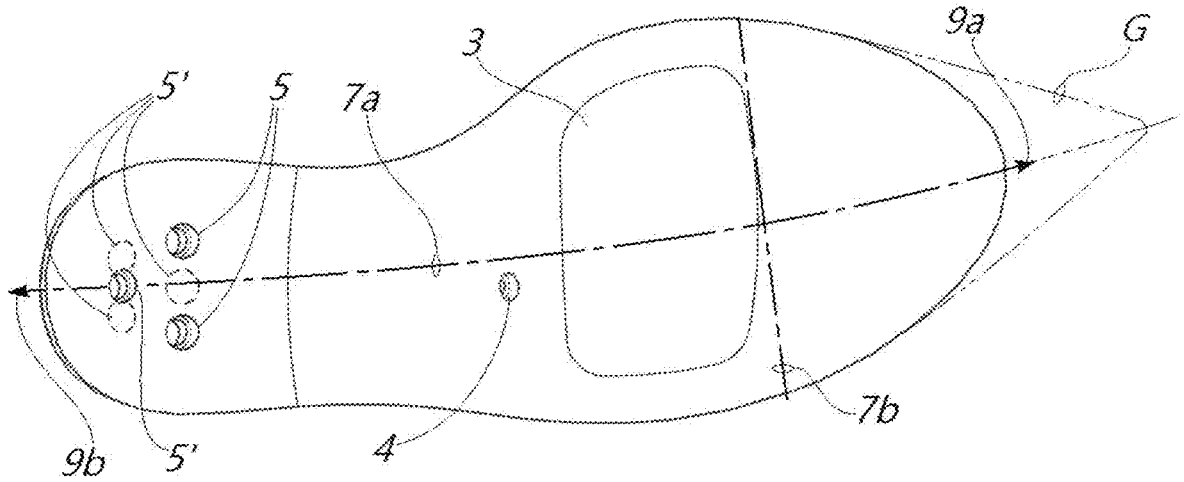
FIG. 2 shows a top view of the shoe of FIG. 1.

FIG. 2 shows a top view of the shoe of FIG. 1. The outer sole defines a longitudinal medial contour [7*a*]which further defines forward direction [9*a*] and a rearward direction [9*b*.] The outer sole also defines a ball line [7*b*] substantially transverse to the longitudinal medial contour taken at the widest extent of the outer sole. In this specification, "substantially transverse" refers to a first entity oriented within 20° of perpendicular to a second entity. The outer sole also includes a pocket [3] which by its perimeter defines a pocket area, and according to a preferred embodiment within the scope of the invention at least 75% of the pocket area is located rearward of the ball line. Fasteners in the heel section secure a heel counter to the heel portion of the outer sole component.

A first exemplary pattern of fastener receiving apertures [5] is shown as a preferred arrangement and a second pattern of apertures [5'] is also shown as an alternate embodiment. Other arrangements of these apertures also reside within the scope of the invention. According to alternative embodiments also residing within the scope of the invention, the contour [G] of the shoe tip may extend past the toes of the wearer to converge partially or completely to a point or a rounded point, and the toe strap or toe box may be open or closed at the tip. The shoe as an assembly also includes a shank component embedded within the outer sole or the insock component, such as by insert molding. The shank is optionally transfixed by at least one fastener which would seat in aperture [4] in this figure. Additional fasteners for securing the shank within the shoe assembly may also be located in the throat section of the shoe assembly.

Figure 3:
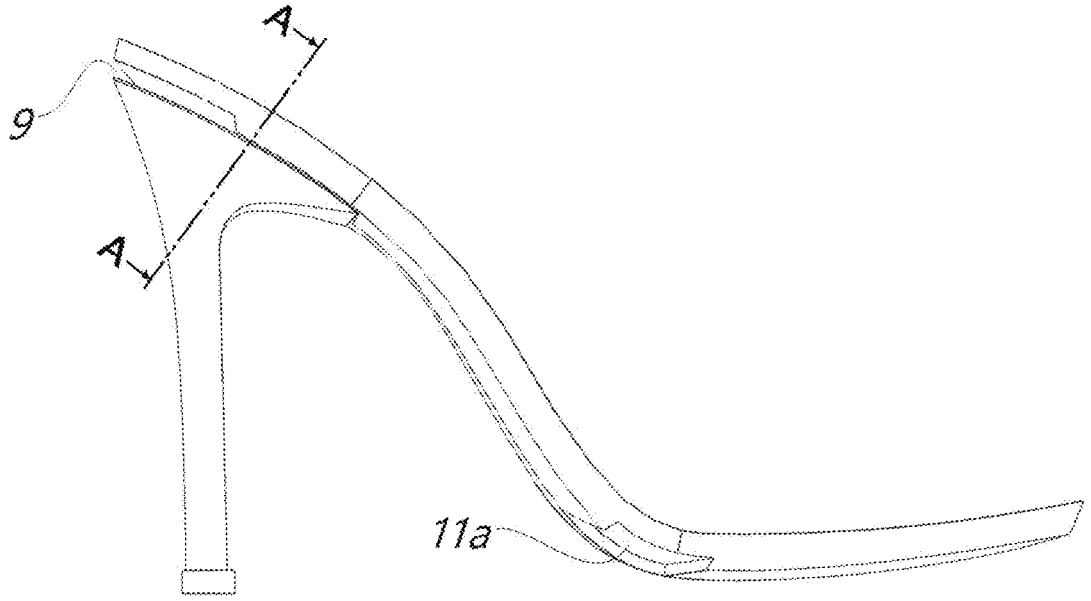
FIG. 3 shows a right side view of the shoe of FIG. 1 and defines cross section line A-A for FIG. 6*a*.
Figure 6A:
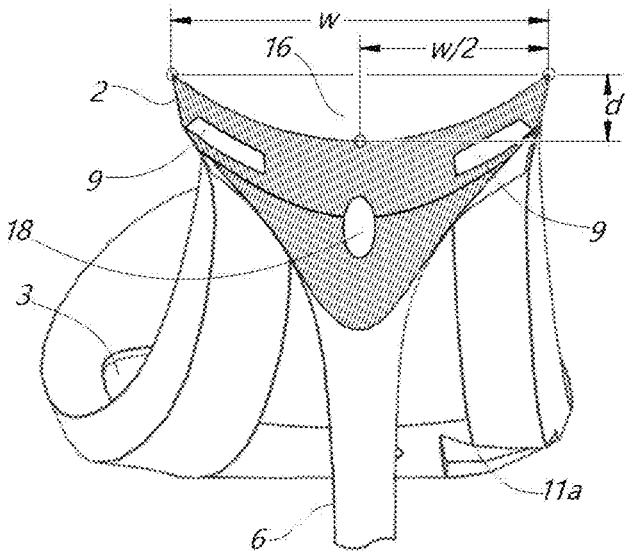
FIG. 6*a* shows a cross section view of the shoe of FIG. 1 taken at section line A-A of FIG. 3.

FIG. 3 shows a right side view of the shoe of FIG. 1 and also defines a cross section line A-A for the cross section view of FIG. 6*a*. The outer sole shoe component further comprises an undercut [9] by the heel which receives a heel counter, and undercuts such as [11*a*] in the ball portion which receive ends of a toe band of a shoe assembled with the inventive outer sole.

Figure 4:
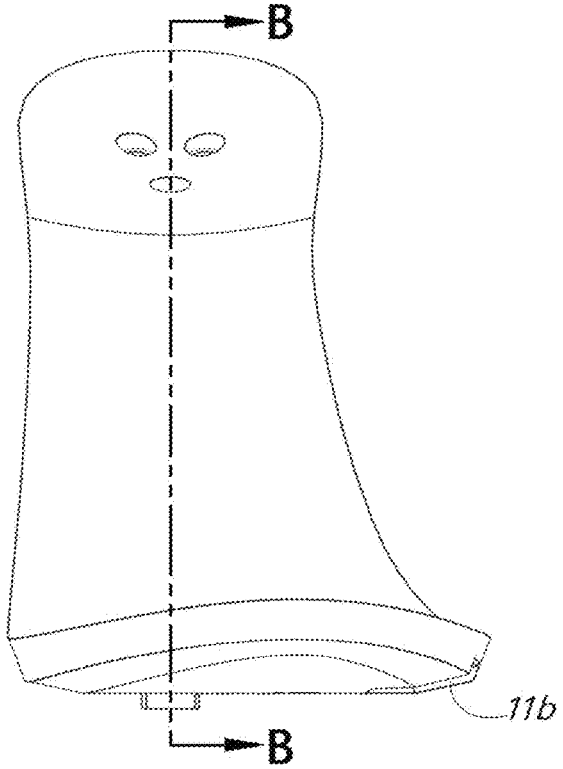
FIG. 4 shows a front view of the shoe component of FIG. 1, and defines cross section line B-B for the cross section view FIG. 7.

FIG. 4 shows a front view of the shoe component of FIG. 1, and defines cross section line B-B for the cross section view of FIG. 7. The undercut [11*b*] in the left side of this right-foot embodiment receives the opposite end of a toe band than the end received in the undercut [11*a*] of FIG. 3. The cross section line B-B in this view also defines a sagittal plane of the shoe.

Figure 5:
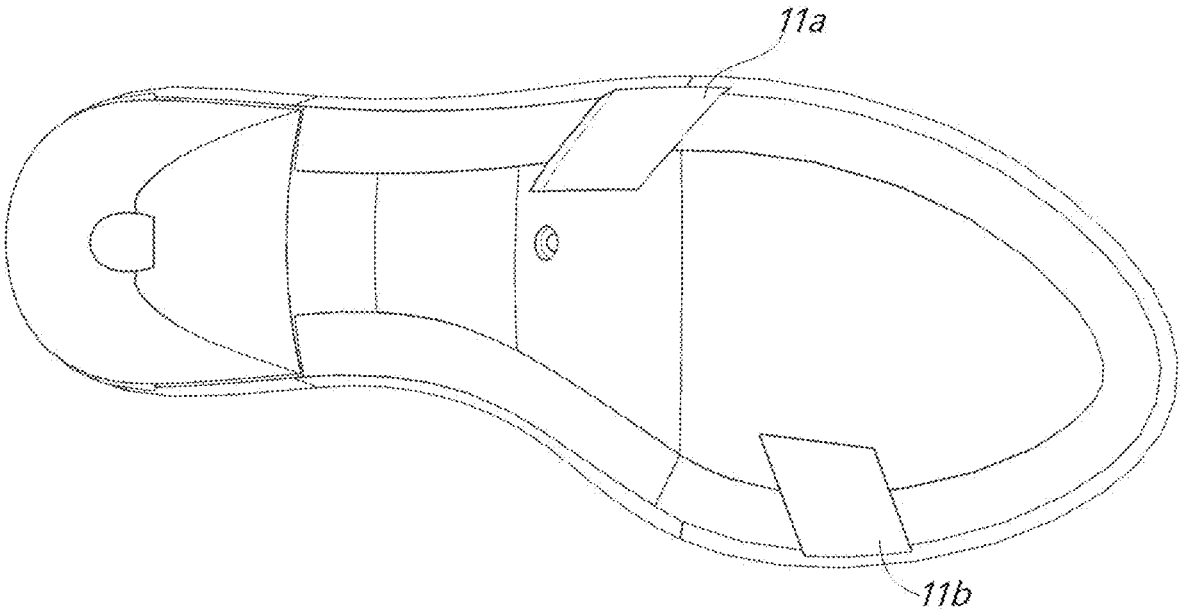
FIG. 5 shows a bottom view of the shoe component of FIG. 1.

FIG. 5 shows a bottom view of the shoe component of FIG. 1. The first and second undercuts [11*a*] and [11*b*] are both seen, for respectively receiving first and second ends of a toe strap or toe band for the shoe assembly.

FIG. 6*a* shows a cross section view of the shoe of FIG. 1 taken at section line A-A of FIG. 3. Because the plane cuts at a slanted, non-perpendicular angle to the axis of the reinforcing column [18] embedded within the heel pillar [6] of the shoe component, where a round bar or rod is used as a reinforcing column it appears in this cross section view as an ellipse. Other bar cross sections reside within the scope of the invention including square, rectangular, hexagonal or other polygonal shapes, and also a bar comprising structural channels such as I-beams, W-sections, H-beams, and rail cross sections may also be used as a reinforcing column within the scope of the invention. Hollow tubes may also be used as a reinforcing column within the scope of the invention.

Also, in embodiments (such as an example seen in FIG. 7*a*) wherein the outer sole [2] includes a downward protruding stud, this ellipse portion would be solid and contiguous with the outer sole. A portion of the outer sole pocket [3] is visible in this view, and portions of the heel counter undercut [9] are also visible in this view. According to preferred embodiments the heel counter undercut is arcuate, following the contour of the perimeter of the heel section of the outer sole, and includes at least one positively curved surface which comports with the heel cup. A portion of one of the toe band undercuts [11*a*] is also visible in this view. The heel cup of this design offers a wider support base than currently available comparable high heeled shoes, which substantially increases comfort and stability even though the narrow pillar maintains the slender aesthetics associated with high heeled shoes, which typically offer a flat floor in this heel section.

The outer sole of the inventive shoe component defines a heel cup [16] having a transverse width dimension [w] and with a depth dimension [d] defined from a point within 15% of a true midpoint [w/2] of a line extending across the lateral ridges of the heel cup as seen in this cross section view. According to a preferred embodiment, this depth is at least 17% of the transverse width dimension, so that lateral stability and comfort is supplied to the heel and especially the medial process of the calcaneus bone. According to a preferred embodiment the depth of the cup is between 5 mm and 15 mm.

Figure 6B:
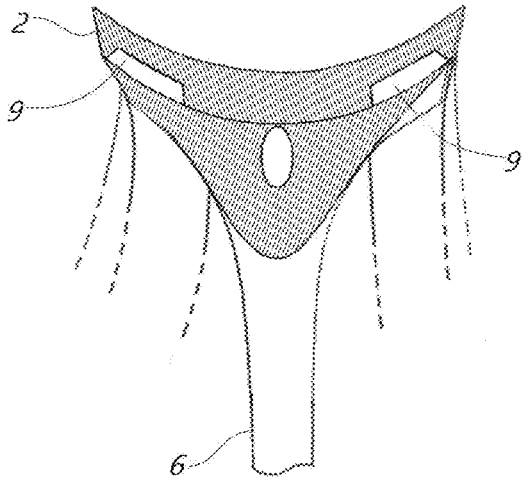
FIG. 6*b* shows a cross section view of the shoe of FIG. 1 taken at section line A-A of FIG. 3, but illustrating an alternative embodiment within the scope of the invention.

FIG. 6*b* shows a cross section view of the shoe of FIG. 1 taken at section line A-A of FIG. 3, but illustrating an alternative embodiment within the scope of the invention wherein the heel counter undercut [9] is defined as a cavity between the outer sole component [2] and the heel pillar component [6] of the shoe assembly.

Figure 7A:
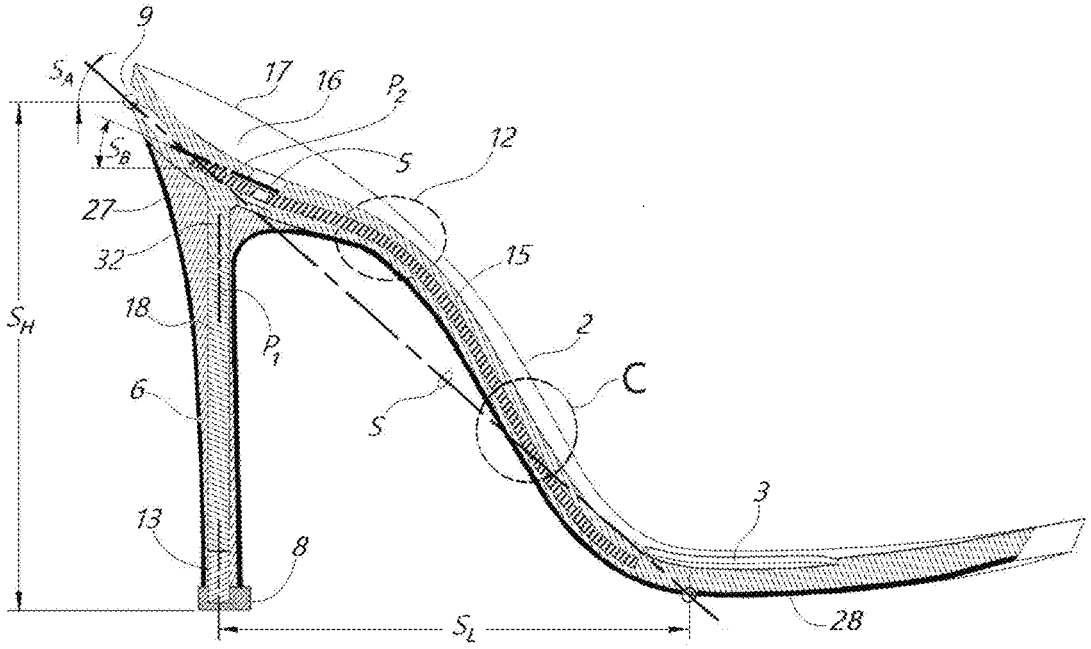
FIG. 7*a* shows a cross section view of the shoe of FIG. 1 taken at section line B-B of FIG. 4 and defines Detail "C" for the detail view of FIG. 7*b*.
Figure 7B:
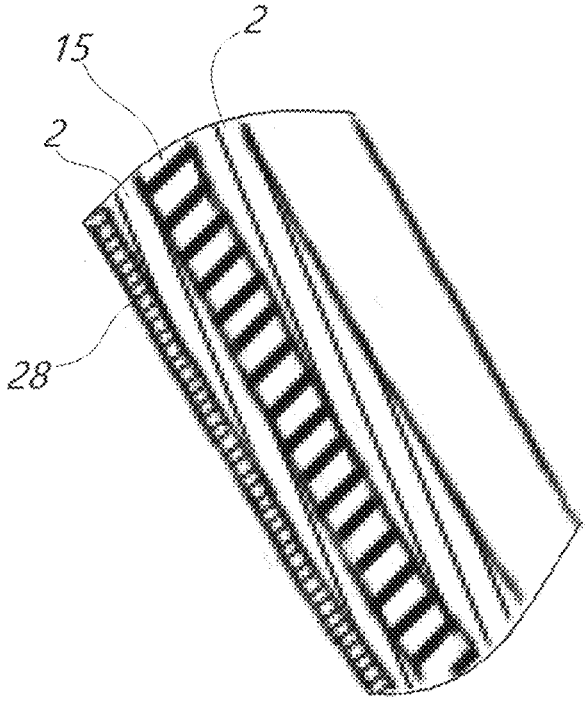
FIG. 7*b* shows an enlarged view of the portion of FIG. 7*a* defined by Detail "C" therein.

FIG. 7*a* shows a cross section view of the shoe of FIG. 1 taken at section line B-B of FIG. 4 and defines Detail "C" for the detail view of FIG. 7*b*. The heel cup [16] and a rim [17] of the heel cup of the outer sole [2] are shown, and also an insert molded shank [15] preferably made of steel or a metal or any suitably resilient material. The rear aspect of the heel counter undercut [9] is also visible in this view, and the pocket [3] for receiving the gel pad is also seen. The material of the outer sole continues in the form of a heel pillar [6] defining a support axis [$P_1$] which includes an embedded reinforcement column [18] which may preferably be a steel tube or solid bar. One aperture [5] from among the plurality of fastener apertures for fastening the outer sole and insock to the heel pillar is also visible in this cross section. Where at least three of the centers of the through apertures of the heel cup define a plane [$P_2$,] a first slope of the plane may be taken at its intercept with a sagittal plane of the shoe, which in this figure is the view plane of this figure and is section line B-B seen in FIG. 4. The angle from horizontal of this plane is [SE] which is also a first slope.

A second slope [$S_A$] may be defined as an angle from horizontal to a line [S] passing through a first point in this sagittal plane at a rearmost ground contact point of a ground contact region of the shoe proximal to the pocket and a second rearmost point of the outer sole in this sagittal plane proximal to the undercut for the heel counter. The distance from the support axis of the heel pillar to the first point is [$S_L$,] and the height from ground to the second point is [$S_H$,] and the first angle [$S_B$] with respect to horizontal that is less than the second slope [$S_A$.]

According to a best mode as illustrated, the second slope [$S_A$] is about 40.5° in this figure, and first angle [$S_B$] is about 21.5°. The invention is practicable with [$S_A$] being within a range spanning inclusively from at least about 35° to about 60° as a maximum value, and with the first angle [$S_B$] being within a range spanning inclusively from at least about 10° to about 40° as a maximum value, but so that the heel pocket forms a ramp angle being the difference of angle [$S_A$] minus angle [$S_B$] and with this ramp angle being within a range spanning inclusively from at least about 10° to about 30° as a maximum value. In this specification, the word "about" when referencing a numerical value may be taken to mean an actual value within a range spanning inclusively between 10% above and 10% below the numerical value.

A dowel [13] which may be made of metal such as steel, aluminum, or brass, is disposed partially within the heel pillar and partially within the top lift [8] beneath the heel pillar. The top lift is preferably made of hard or tough material, wherein hardness is defined as resistance to indentation and toughness is defined as endurance or resistance to erosion by abrasion. The top lift may also be a composite structure comprising soft plastic or hard rubber. The top lift may also be overmolded onto the dowel.

The outer sole further defines a heel cup and a throat section connected by a negatively curved surface at a transition surface [12] proceeding from the heel cup to the throat section of the insole, optionally and preferably in the form of a negatively curved, or saddle-shaped 3-dimensional surface.

Other unimproved designs usually include just a simple, axial bend which results in a laterally flat transverse ridge which is less comfortable to wear when standing. According to another embodiment within the scope of the invention, the shank may be insert-molded without the use of fasteners or rivets. According to yet another embodiment within the scope of the invention, the reinforcing column is made shorter than the length of the heel pillar so that it stops short, recessed within the heel pillar, and forms a downward pointing aperture, and a top lift complementary to this particular embodiment includes a protruding dowel which may be insert molded into the top lift. The protruding portion of this dowel is received within the downward-pointing aperture and coaxially abuts to the reinforcement column in the heel pillar. The dowel partially protrudes from the heel pillar, and the top lift is affixed to the dowel.

In the exemplary embodiment as shown, the dowel is abutted to and coaxial to the reinforcement column in the heel pillar and partially protrudes from the heel pillar, and the top lift is affixed to the dowel.

According to yet other embodiments within the scope of the invention, an outer sole may further comprise a downwardly protruding stud [32] coaxially aligned with the support axis of the heel pillar. Additional cosmetic components for the shoe include membranes of material which shroud the heel pillar. The membranes may include fabric, leather, or synthetic materials. One rear membrane [27] resembles the fantail of a ship, and its forward edges join to a second membrane [28] which extends beneath the outer sole and the forward tread area of the shoe.

FIG. 7*b* shows an enlarged view of the portion of FIG. 7*a* defined by Detail "C" therein. The shank [15] is embedded within the outer sole material [2] and the ornamental membrane [28] passes along the underside of the outer sole.

Figure 8:
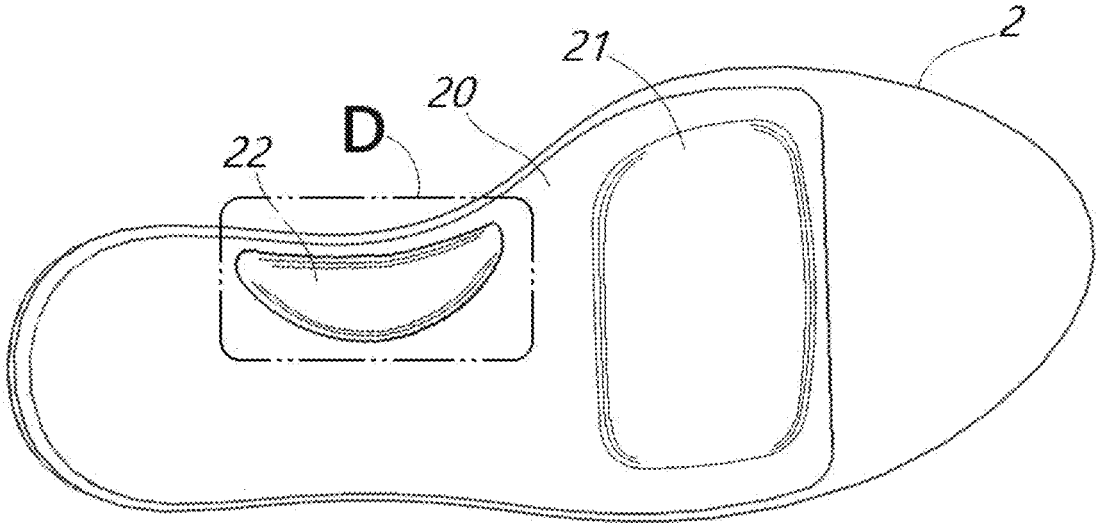
FIG. 8 shows a top view of the shoe of FIG. 1, including an insock having compliant pads, and also defines a phantom line closed contour for detail view "D" of the gel pad as seen in FIG. 9*b*.
Figure 9A:
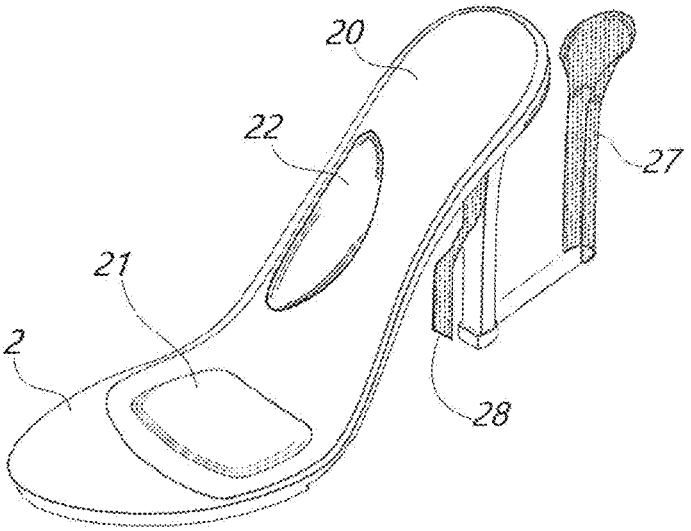
FIG. 9*a* shows a front, left, top view of the shoe with insock of FIG. 8 and with portions of the outsole exploded or peeled away from the heel pillar.
Figure 9B:
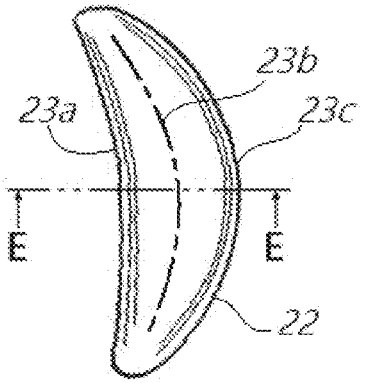
FIG. 9*b* shows an enlarged view of the portion of FIG. 8 defined by Detail "D" therein, and defines section line E-E for the cross section view FIG. 9*c*.

FIG. 8 shows a top view of the shoe of FIG. 1, including an insock [20] having compliant pads, and also defines a phantom line closed contour for detail view "D" of the gel pad as seen in FIG. 9*b*. Most insock designs in current use do not include any arch supports or transverse features for resisting longitudinal sliding of the foot while worn within a shoe.

According to preferred embodiments, the insock comprises a first shock-absorbing gel pad and a second component comprising high-rebound memory foam affixed atop the gel pad, both sandwiched between fabric layers adhered to each other by an adhesive. The pads may then be covered by a pad cap [21] which is a membrane of material that aesthetically matches the rest of the insock of the shoe. The insock may be secured to the outer sole [2] by adhesive or by mechanical means such as stitching, so that the gel pad is registered within the pocket of the outer sole. The rear ridge of the gel pad bolsters the wearer's foot by supplying reaction forces counteracting longitudinal forces within the foot which would otherwise allow the foot to slide down the throat section of the outer sole. Another substantial portion of these longitudinal forces is taken up by the forward rim of the heel cup.

The insock of this high-heeled shoe further comprises a second, semilunar pad component [22] located partway along the throat of the insock so that it resides beneath the instep of the wearer's foot as an additional feature for collecting longitudinal forces in the foot and eliminating an unwanted feeling of "sliding down a ramp." The relative geometry of the two slopes [$S_A$] and [$S_B$] as discussed in FIG. 7*a* also reduce or eliminate the "sliding down the ramp" effect which makes most high-heeled shoes less comfortable or less stable to walk in. The semilunar pad component comprises a compressible material such as an elastomer foam or a gel pad.

Besides furnishing shoes in given or standard sizes, a shoe of a selected size may also be customized by request to include arch support pads selected from a variety of shapes, thicknesses, durometer, and contours so that a manufacturer may offer tailored products uniquely and specifically formed to particular customers.

FIG. 9*a* shows a front, left, top view of the shoe with insock [20] of FIG. 8 and with portions of the outer sole [2] exploded or peeled away from the heel pillar. The first gel pad and high-rebound memory foam component are covered by a cosmetic cap [21,] and the insock further comprises a second, semilunar pad [22.] The heel pillar is shrouded by cosmetic membranes which in this view are shown shaded. The forward membrane [28] extends along the underside of the shoe, and the rear membrane [27] encompasses the rear or "fantail" portion of the heel pillar.

Figure 9C:
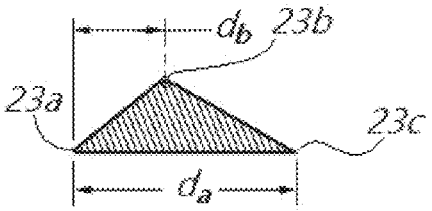
FIG. 9*c* shows a cross section view of the semilunar pad component of FIG. 9*b* taken at section line E-E therein.

FIG. 9*b* shows an enlarged view of the semilunar pad [22] seen within the portion of FIG. 8 defined by Detail "D" therein, and defines section line E-E for the cross section view FIG. 9*c*. The semilunar pad comprises an inside curve contour [23*a*,] an outside curve contour [23*c*,] and a ridge [23*b*] which is a line where the gel pad protrudes the most from the underlying insock surface.

FIG. 9*c* shows a cross section view of the semilunar pad component of FIG. 9*b* taken at section line E-E therein. At this cross section taken at a transverse cross section of the semilunar pad, and at other cross sections substantially perpendicular to the ridge [23*b*] seen in FIG. 9*b*, the semilunar pad has a width [$d_a$] defined between the inside curve contour [23*a*] and the outside curve contour [23*c*.] In preferred embodiments within the scope of the invention, a first distance [$d_b$] defined from the inside curve contour to the ridge resides within a range between about 22% and about 40% inclusively of the width of the semilunar pad, this width being a second distance defined from the inside curve contour to an outside curve contour.

Figure 10A:
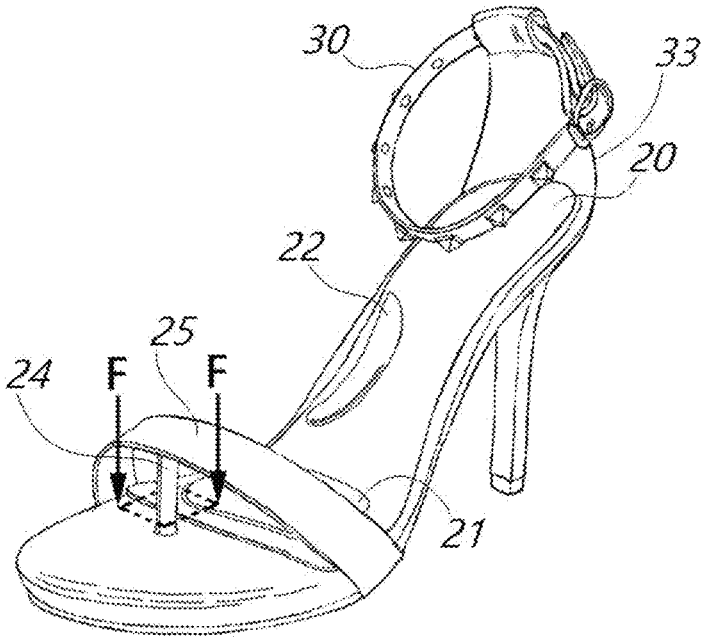
FIG. 10*a* shows a front, left, top view of an embodiment of a complete shoe assembly including the shoe component and insock of FIG. 8, and including a heel counter, an ornamental ankle bracelet, a toe strap, and a toe post, and defines a cutting plane F-F for the cross section view FIG. 10*b*.
Figure 10B:
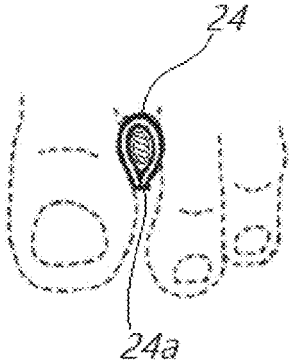
FIG. 10*b* shows a cross section view of a toe post and toe post sleeve in accordance with the invention taken at the cutting plane E-E defined in FIG. 10*a*.

FIG. 10*a* shows a front, left, top view of an embodiment of a complete shoe assembly including the shoe components and insock [20] of FIG. 8, and including a heel counter [33,] an ornamental ankle bracelet [30,] a toe strap [25,] and a toe post [24,] and defines a cutting plane F-F for the cross section view FIG. 10*b*. The cap [21] for the pocket receiving the first shock-absorbing gel pad and the second high-rebound memory foam pad, and the semilunar pad [22] are also visible in this view. The toe post spans between the insock and the toe strap, the toe post being optionally and preferably shrouded by a seamed toe post sleeve [24.]

The ornamental ankle bracelet is detachable from the heel counter. In the embodiment shown, the heel counter includes a loop feature which is a closed loop and the ornamental ankle bracelet passes through the loop. The ornamental ankle bracelet in this example includes a closure which is a buckle, which allows the closed loop of the ornamental ankle bracelet to be opened and removed from the closed loop of the heel counter. An alternate arrangement within the scope of the invention includes that the loop feature of the heel counter is an openable and closable clasp, which may enclose both the type of ankle bracelet having an openable and closable clasp or buckle of its own and also may enclose an alternative type of ornamental ankle bracelet which is a continuous and closed loop. The loop feature of the heel counter may also be designed large enough to enclose two or more ankle bracelets to be worn concurrently.

In both types of embodiments as described, the user may over time or in an initial purchase of the shoes acquire a set consisting of a plurality ornamental ankle bracelets associated with the shoe, and alter the appearance of the shoe by selecting any one or more from the plurality of ornamental ankle bracelets. Thus, the user may adapt the appearance of the shoe at whim to conform to ephemeral fashion trends or to signal participation with social movements which have recognized indicia by acquiring and configuring the shoe to display an ornamental ankle bracelet conforming to the latest fashion or bearing the indicia associated with a personage, celebrity, sports or entertainment franchise, political affiliation or protest thereof, or any cause of the day.

FIG. 10*b* shows a cross section view of a toe post shrouded by a toe post sleeve [24] in accordance with the invention taken at the cutting plane E-E defined in FIG. 10*a*. Rather than a seamless tube, manufacturing is eased by forming material around the toe post and closing the sleeve by stitching or adhesive or both, leaving a seam. For best comfort, the seamed sleeve is oriented with the seam residing proximal to a forward extent of the toe post. This preferred orientation prevents or at least minimizes contact by the wearer's toes as they bestride the toe post. The preferred orientation also and especially prevents the seam and its stitching or other closure (such as when using a fabric adhesive to form the toe post sleeve) from contacting and irritating the sensitive web of skin between wearer's first and second toes.

While certain features and aspects have been described with respect to exemplary embodiments, one skilled in the art will recognize that numerous modifications are possible. Also, while certain functionality is ascribed to certain system components, unless the context dictates otherwise, this functionality may be distributed among various other system components in accordance with the several embodiments.

Moreover, while the procedures of the methods and processes described herein are described in a particular order for ease of description, unless the context dictates otherwise, various procedures may be reordered, added, and/or omitted in accordance with various embodiments. Furthermore, the procedures described with respect to one method or process may be incorporated within other described methods or processes; likewise, system components described according to a particular structural configuration and/or with respect to one system may be organized in alternative structural configurations and/or incorporated within other described systems.

The present disclosure is not to be limited in terms of the particular embodiments described in this application, which are intended as illustrations of various aspects. Many modifications and variations may be made without departing from its spirit and scope. Functionally equivalent methods and apparatuses within the scope of the disclosure, in addition to those enumerated herein, are possible from the foregoing descriptions. Such modifications and variations are intended to fall within the scope of the appended claims. The present disclosure is to be limited only by the terms of the appended claims, along with the full scope of equivalents to which such claims are entitled.

Hence, while various embodiments are described with or without certain features for ease of description and to illustrate exemplary aspects of those embodiments, the various components and/or features described herein with respect to a particular embodiment may be substituted, added, and/or subtracted from among other described embodiments, unless the context dictates otherwise. Thus, unauthorized instances of apparatuses and methods claimed herein are to be considered infringing, no matter where in the world they are advertised, sold, offered for sale, used, possessed, or performed.

Consequently and in summary, although many exemplary embodiments are described above, it will be appreciated that the invention is intended to cover all modifications and equivalents within the scope of the following claims.

What is claimed is:

1. A high-heeled shoe comprising:

a heel pillar, an outer sole, and an insock, with said heel pillar defining a support axis and comprising a reinforcement column, and said outer sole defining a longitudinal medial contour further defining forward and rearward directions, and defining a ball line substantially transverse to said longitudinal medial contour, and further comprising a pocket defining a pocket area, with at least 75% of said pocket area located rearward of said ball line, and further comprising an insert molded shank, with a first gel pad received within said pocket and a component comprising high-rebound memory foam affixed atop said first gel pad, and said outer sole further defining a heel cup having a plurality of fastener-receiving through apertures having centers non-coaxial with said support axis, such that brachial support axes each passing through said aperture centers converge upon said support axis at a point beneath said heel cup.

2. The high-heeled shoe of claim 1, wherein said reinforcing column is recessed within said heel pillar to form a downward-pointing aperture, and further comprising a top lift having a protruding dowel received within said downward-pointing aperture and abutted to and coaxial to said reinforcement column in said heel pillar.

3. The high-heeled shoe of claim 1, further comprising a dowel abutted to and coaxial to said reinforcement column in said heel pillar and partially protruding from said heel pillar, and a top lift affixed to said dowel.

4. The high-heeled shoe of claim 3, wherein said insock further comprises a second, semilunar pad comprising a compressible material.

5. The high-heeled shoe of claim 4, wherein said semilunar pad further comprises an inside curve contour, an outside curve contour, and a ridge, and wherein a semilunar pad width is defined between said inside curve contour and said outside curve contour taken at a transverse cross section of said semilunar pad, and wherein a first distance defined from said inside curve contour to said ridge resides within a range between about 22% and about 40% inclusively of a second distance defined from said inside curve contour to said an outside curve contour.

6. The high-heeled shoe of claim 1, wherein said shank is transfixed by a fastener.

7. The high-heeled shoe of claim 1, wherein said outer sole further comprises first and second undercuts which respectively receive first and second ends of a toe strap.

8. The high-heeled shoe of claim 1, wherein said outer sole further comprises an undercut by the heel which receives a heel counter.

9. The high-heeled shoe of claim 8, wherein said undercut is defined as a cavity between said outer sole and said heel pillar.

10. The high-heeled shoe of claim 1, wherein at least three of said centers of said through apertures of said heel cup define a plane, and a first slope of said plane taken at its intercept with a sagittal plane of said shoe has a first angle with respect to horizontal that is less than a second slope of a line passing through a first point in said sagittal plane at a rearmost ground contact point of a ground contact region of said shoe proximal to said pocket and a second rearmost point of said outer sole in said sagittal plane proximal to said undercut.

11. The high-heeled shoe of claim 10, wherein said heel cup defines a transverse width dimension and with a depth dimension of said heel cup being at least 17% of said transverse width dimension.

12. The high-heeled shoe of claim 10, wherein said second slope resides within a range spanning inclusively from at least about 35° to about 60'.

13. The high-heeled shoe of claim 10, wherein said second slope is about 40.5°.

14. The high-heeled shoe of claim 10, wherein said first slope resides within a range spanning inclusively from at least about 10 to about 40°.

15. The high-heeled shoe of claim 10, wherein said first slope is about 21.5°.

16. The high-heeled shoe of claim 10, wherein a difference of said second slope minus said first slope resides within a range spanning inclusively from at least about 10° to about 30°.

17. The high-heeled shoe of claim 1, wherein said outer sole further defines a heel cup and a throat section connected by a negatively curved surface.

18. The high-heeled shoe of claim 7, further comprising a toe post spanning between said insock and said toe strap, said toe post shrouded by a seamed toe post sleeve, with said seam of said toe post sleeve residing proximal to a forward extent of said toe post.

19. The high-heeled shoe of claim 1, wherein said outer sole further comprises a downwardly protruding stud coaxially aligned with said support axis of said heel pillar.

20. The high-heeled shoe of claim 1, further comprising a heel counter having a loop feature, and an ornamental ankle bracelet detachable from said heel counter, said ornamental ankle bracelet being selected from among a set consisting of a plurality of ornamental ankle bracelets associated with said high-heeled shoe.

* * * * *